US005175589A

United States Patent [19]

Kimura

[11] Patent Number: 5,175,589

[45] Date of Patent: Dec. 29, 1992

[54] TRANSFER CONVEYANCE UNIT

[75] Inventor: Kazuyoshi Kimura, Hachioji, Japan

[73] Assignee: Konica Corporation, Tokyo, Japan

[21] Appl. No.: 885,159

[22] Filed: May 18, 1992

[30] Foreign Application Priority Data

May 23, 1991 [JP] Japan ..... 3-118355

[51] Int. Cl.[5] ..... G03G 15/14

[52] U.S. Cl. ..... 355/271; 355/273; 355/277

[58] Field of Search ..... 355/271, 272, 273, 277, 355/280-281, 200

[56] References Cited

U.S. PATENT DOCUMENTS

| | | | |
|---|---|---|---|
| 4,316,666 | 2/1982 | Ceelen | 355/280 X |
| 4,998,143 | 3/1991 | Kumasaka et al. | 355/271 |
| 5,121,166 | 6/1992 | Miyamoto et al. | 355/281 |

FOREIGN PATENT DOCUMENTS

| | | | |
|---|---|---|---|
| 3109036 | 1/1982 | Fed. Rep. of Germany | 355/277 |
| 0311369 | 12/1988 | Japan | 355/277 |
| 0029677 | 1/1990 | Japan | 355/277 |
| 0062076 | 3/1991 | Japan | 355/277 |

*Primary Examiner*—A. T. Grimley
*Assistant Examiner*—Matthew S. Smith
*Attorney, Agent, or Firm*—Jordan B. Bierman

[57] ABSTRACT

A transfer unit comprises a conveyance device for conveying a recording sheet, transfer device for transferring a toner image from an image carrying member onto the recording sheet, a rotatable frame for fixing thereon the conveyor device and the transfer device, a base for supporting the rotatable frame at a rotation center, and a pusher device located between the base means and the rotatable frame for pushing the rotatable frame toward the image carrying member. The transfer device is fitted to a surface of the image carrying member by a rotation caused by the push from the pushing device.

5 Claims, 6 Drawing Sheets

TRANSFER CONVEYANCE UNIT

BACKGROUND OF THE INVENTION

The present invention relates to a transfer conveyance unit, the rotatable transfer shaft of which comes into contact with the circumferential surface of a photoreceptor drum through a conveyance belt so that a transfer paper can be conveyed while toner on the drum surface is transferred onto the paper.

Recently, many copiers can be opened like a clamshell in such a manner that an upper portion of the copier is separated from a lower portion with regard to a recording paper conveyance passage. In the copier mentioned above, a photoreceptor drum is provided in the upper portion of the copier, and a transfer conveyance unit is provided in the lower portion. Accordingly, this type of copier is advantageous in that jam clearance can be easily carried out when the upper portion of the copier is opened.

Recently, color copiers have come into wide use. When a color image is formed on a photoreceptor drum surface, various image forming methods are used. In a color image forming system in which toner of different colors is sequentially superimposed on the surface of a photoreceptor drum each time the photoreceptor drum is rotated, the transfer conveyance unit is sufficiently separated from the drum surface during color image formation, and after color image formation has been completed, the transfer conveyance unit comes into contact with the photoreceptor drum in order to transfer the image formed on the drum surface onto a recording paper.

When a transfer shaft and transfer belt are contacted with the photoreceptor drum in the aforementioned copier, an idle shaft side of the transfer conveyance belt unit is rotated around a drive shaft or a shaft provided close to the drive shaft, and the right and left edge portions of the transfer conveyance unit are pressed against the photoreceptor drum with two compression springs.

However, when the photoreceptor drum or the upper portion of the copier in which the photoreceptor drum is installed, are inclined, or when the transfer conveyance unit is inclined, it is difficult to make the pushing force on the right side of the transfer conveyance unit equal to that on the left side only by the action of the two compression springs. Therefore, unevenness is caused in a transferred image.

The transfer conveyance unit is provided with a transfer shaft upon which a voltage is impressed so that the transfer shaft is electrically charged. Therefore, static electricity tends to accumulate in the transfer conveyance unit, so that problems such as jamming tend to occur. In order to solve this problem, a wire is used for connecting the transfer conveyance unit to ground. However, the load given by the wire greatly affects the movements of the transfer shaft and a frame on which the transfer roller is mounted. Accordingly, there is a possibility that a difference of pushing force is caused between the right and the left portion of the transfer belt and shaft when they are contacted with the photoreceptor drum.

The present invention has been achieved to solve the aforementioned conventional problems. It is a primary object of the invention to provide a transfer conveyance unit of simple structure in which the transfer belt and transfer shaft are positively contacted with the photoreceptor drum and the contact force of the right portion and that of the left portion are balanced.

SUMMARY OF THE INVENTION

In order to accomplish the object, the present invention is to provide a transfer conveyance unit having a transfer belt by which toner is transferred from a photoreceptor drum onto a paper and the paper is conveyed, and the transfer conveyance unit is characterized in that: the right and left portions of an idle shaft of the transfer conveyance unit are rotated and lifted around a drive shaft by two compression springs, wherein the transfer belt is provided between the idle and drive shafts; and at least one of the drive shaft supporting portions can be rotated around the other drive shaft supporting portion. That is, only one of the shaft supporting portions of the drive roller is fixed with regard to the vertical direction, and the other shaft supporting portion of the drive shaft and both shaft supporting portions of the idle shaft are freely movable with regard to the vertical direction so that the transfer conveyance frame can follow the photoreceptor drum even when it is inclined.

The present invention is to provide a transfer conveyance unit having a transfer belt by which toner is transferred from a photoreceptor drum onto a paper and the paper is conveyed, and the transfer conveyance unit is characterized in that: a transfer frame provided with a drive shaft, idle shaft and transfer shaft inscribed inside the transfer belt, is mounted on a base frame in such a manner that the transfer frame can be vertically rotated around the drive shaft; and compression springs are provided between the transfer frame and the base frame, wherein the transfer frame is electrically connected to the image forming apparatus body through the compression springs and a compression spring positioning shaft mounted on the base frame. Accordingly, even when the transfer conveyance unit is electrically connected to the image forming apparatus, the movement of the transfer frame is not affected.

Further, the present invention is to provide a transfer conveyance unit having a transfer belt by which toner is transferred from a photoreceptor drum onto a paper and the paper is conveyed, and the transfer conveyance unit is characterized in that: the right and left edge portions of an idle shaft are lifted with two compression springs in such a manner that the idle shaft is rotated around a drive shaft, wherein the transfer belt is provided between the idle and drive rollers; at least one of the shaft supporting portions of the drive shaft is vertically rotated around the other shaft supporting portion; and an auxiliary spring is provided between the compression springs and the drive shaft.

BRIEF DESCRIPTION OF THE DRAWINGS

FIG. 1-*a* is a schematic illustration showing a state in which the transfer conveyance unit is contacted with the photoreceptor drum with pressure;

FIG. 1-*b* is a schematic illustration showing a state in which the transfer conveyance unit is separated from the photoreceptor drum;

The following drawings show the second example of the present invention.

Figure 4A:
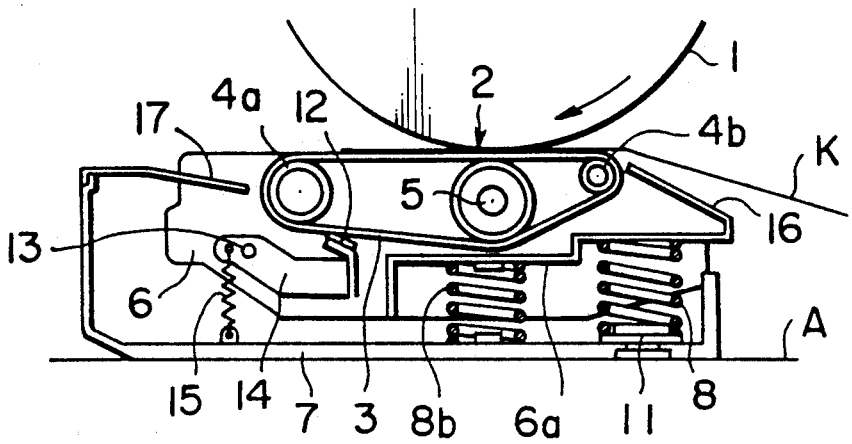
Figure 4B:
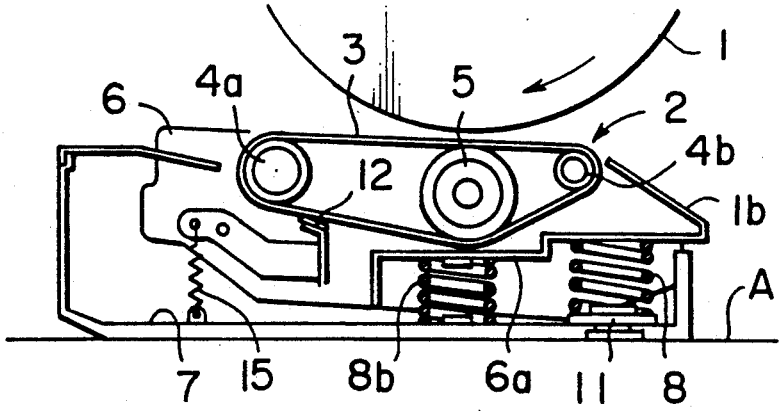

FIGS. 4-*a* and 4-*b* are schematic illustrations showing a relation between a transfer conveyance unit and a photoreceptor drum in the second example.

Figure 5:
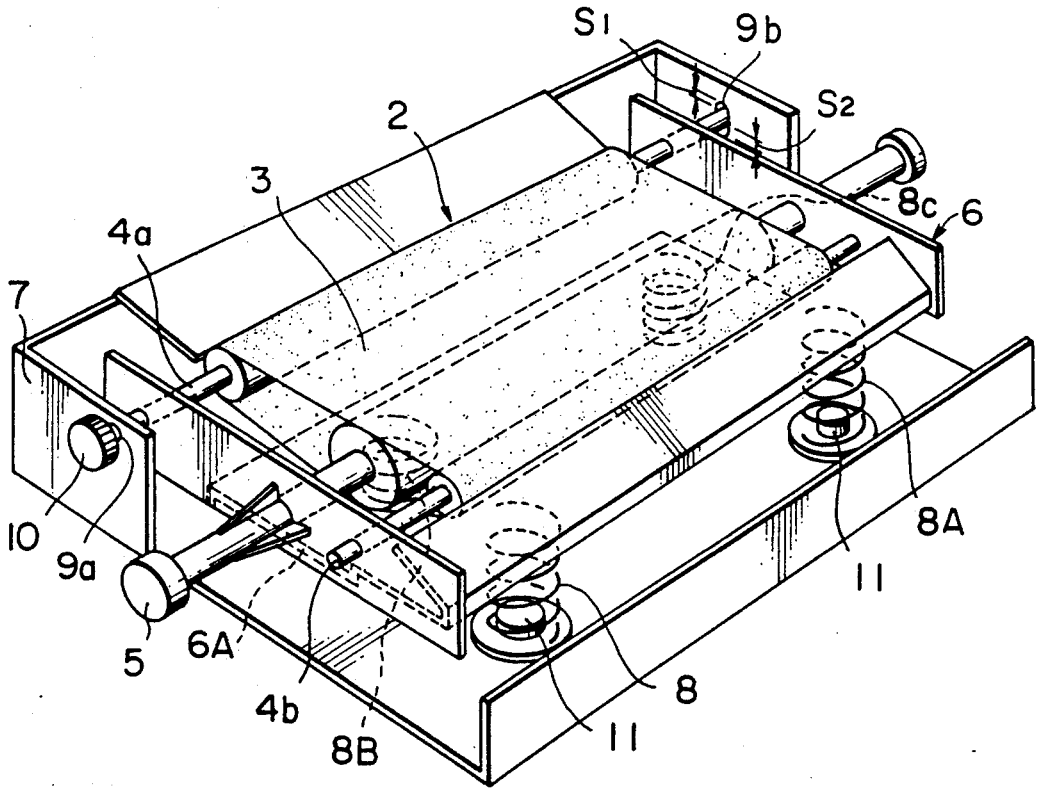
Figure 6:
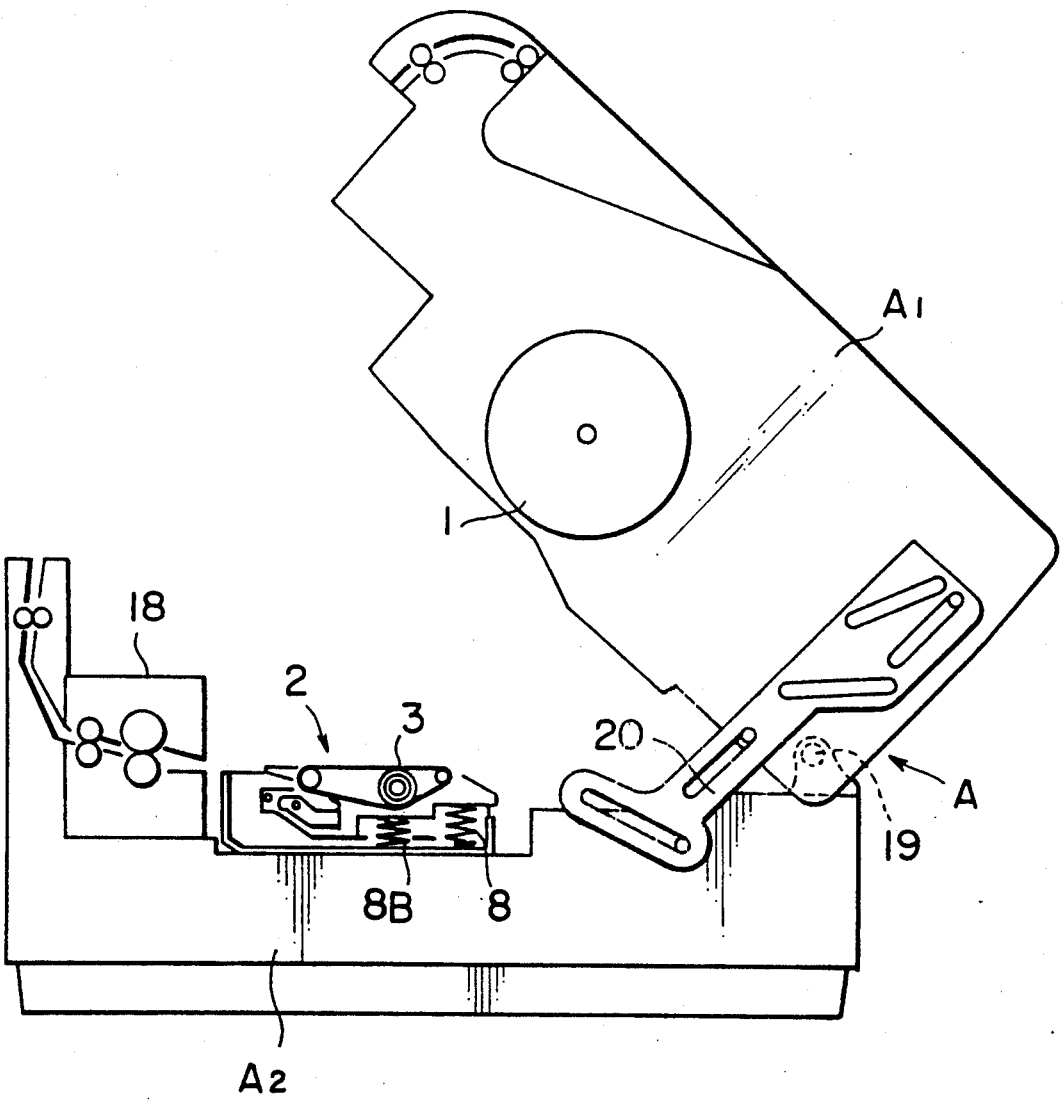

FIG. 4-*a* is a schematic illustration showing a state in which the transfer conveyance unit is contacted with the photoreceptor drum with pressure;

FIG. 4-*b* is a schematic illustration showing a state in which the transfer conveyance unit is separated from the photoreceptor drum;

FIG. 5 is a perspective view showing the transfer conveyance unit of the second example; and FIG. 6 is a schematic illustration showing an image forming apparatus body which has been opened in order to show the position of the transfer conveyance unit of the second example.

DETAILED DESCRIPTION OF THE PREFERRED EMBODIMENTS

Figure 1A:
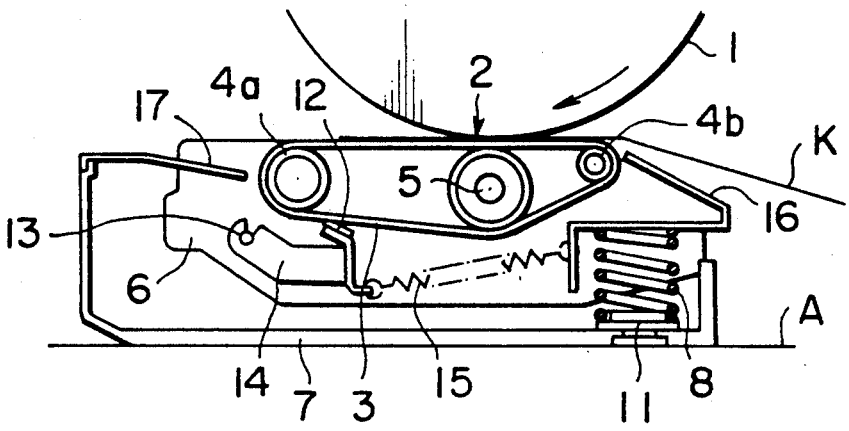
FIGS. 1-*a* and 1-*b* are schematic illustrations showing a relation between a transfer conveyance unit and a photoreceptor drum in the first example.
Figure 1B:
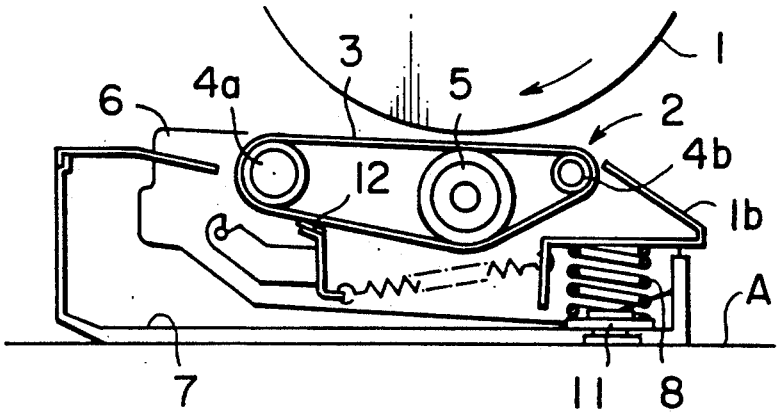
Figure 2:
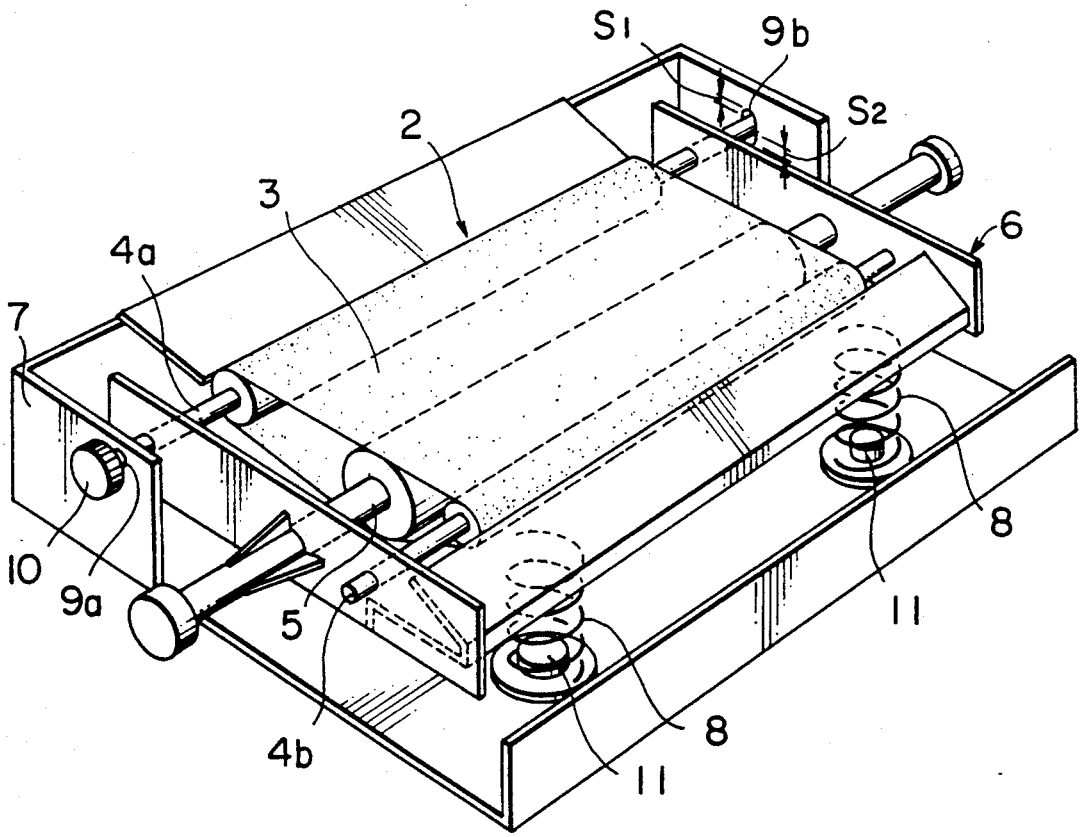
FIG. 2 is a perspective view showing the transfer conveyance unit of the first example.
Figure 3:
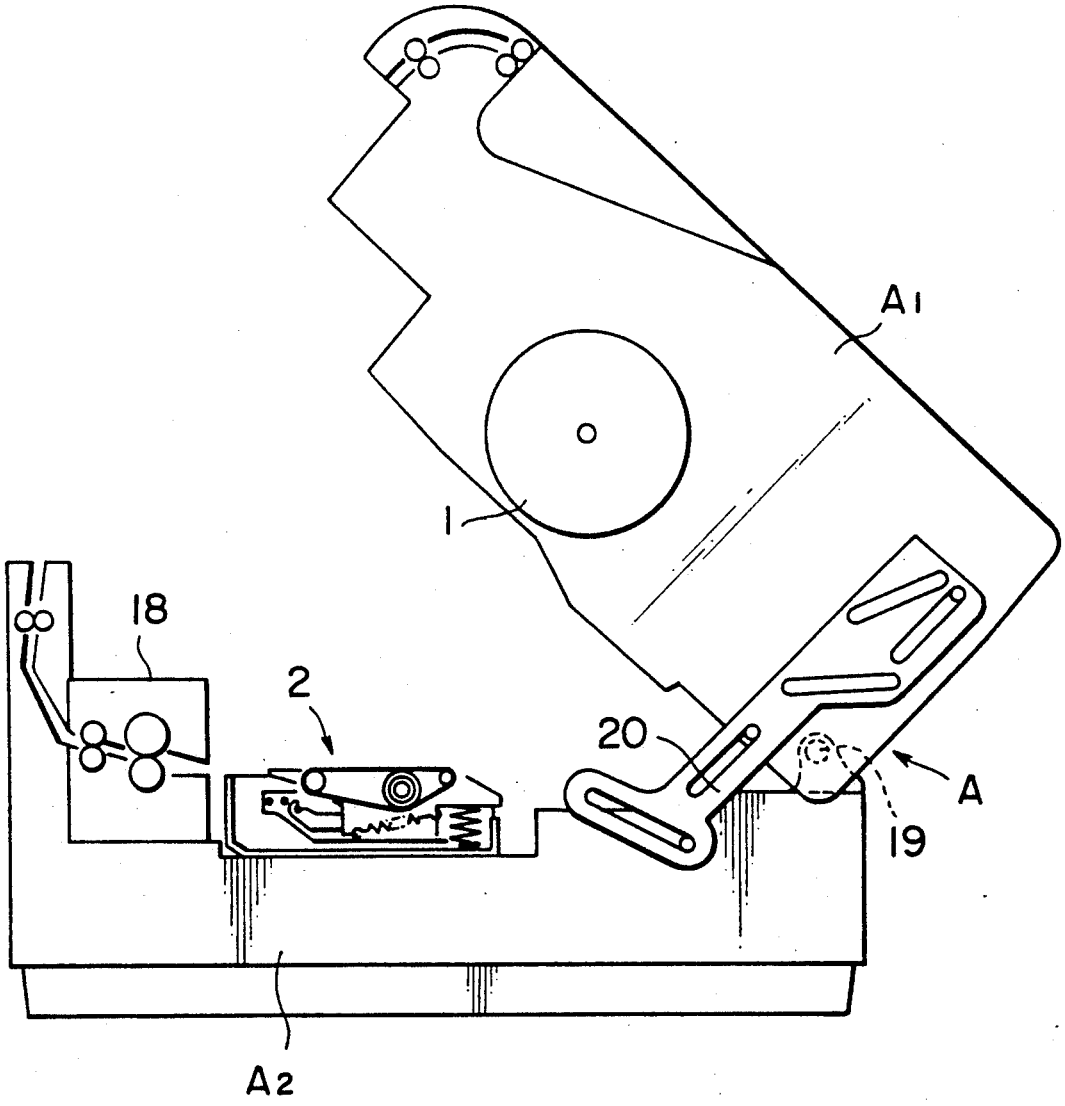
FIG. 3 is a schematic illustration showing an image forming apparatus body which has been opened in order to show the position of the transfer conveyance unit of the first example.

With reference to FIG. 1 through FIG. 3, the first example of the present invention will be explained as follows. FIG. 1-*a* is a schematic illustration showing a state in which the transfer conveyance unit is contacted with the photoreceptor drum with pressure. FIG. 1-*b* is a schematic illustration showing a state in which the transfer conveyance unit is separated from the photoreceptor drum. FIG. 2 is a perspective view showing the transfer conveyance unit of the present invention. FIG. 3 is a schematic illustration showing an image forming apparatus body which has been opened in order to show the position of the transfer conveyance unit of the present invention.

In the attached drawings, numeral 1 is a photoreceptor drum. As shown in FIG. 3, the photoreceptor drum 1 is provided in upper body $A_1$ of image forming apparatus A, wherein upper body $A_1$ can be opened in such a manner that the upper body $A_1$ is separated from the lower body with regard to a paper passage. Numeral 2 is a transfer conveyance unit of the present invention. The transfer conveyance unit 2 is provided mounted on lower body A2 of the image forming apparatus. As shown in FIGS. 1-*a* and 1-*b*, the photoreceptor drum 1 is rotated in the direction of an arrow.

The transfer conveyance unit 2 is provided with a recording paper conveyance belt 3 which comes into contact with the lower surface of the photoreceptor drum 1. The belt 3 is provided between a drive shaft 4*a* and an idle shaft 4*b*. Numeral 5 is a rotatable transfer shaft upon which a voltage is impressed so that it is electrically charged. The transfer shaft 5 comes into contact with the circumferential surface of the drum 1 through the belt 3 so that a transfer section is constituted in order to transfer a toner image onto a recording paper. This transfer shaft 5 transfers a toner image formed on the photoreceptor drum 1 onto recording paper K which is conveyed by the belt 3. Stepped portions are formed on each of the aforementioned drive shaft, idle shaft and transfer shaft, so that each shaft is constituted of a roller portion disposed in the center of the shaft and shaft portions, the diameter of which is small, at both edge portions of the shaft.

Numeral 6 is a frame on which the drive shaft 4*a*, the idle shaft 4*b* and the transfer shaft 5 are mounted. The frame 6 is mounted on a base frame 7 so that the frame 6 can be vertically rotated around the drive shaft 4*a*. The base frame 7 is fixed to image forming apparatus body A. Numeral 8 is a compression spring provided between the frame 6 and the base frame 7. The compression springs 8 lift up right and left ends of the idle shaft 4*b* toward the drum 1. That is, while a transfer operation is performed, the belt 3 and the transfer shaft 5 of the transfer conveyance unit are contacted with the circumferential surface of the drum 1 with pressure.

The drive shaft 4*a* can be rotated around at least one of the shaft supporting portions 9*a*, 9*b* of the frame 7, for example the drive shaft 4*a* can be rotated around the shaft supporting portion 9*a* provided with a gear 10 which is a drive means of the drive roller. For that reason, a hole, the longitudinal dimension of which is longer than the lateral dimension, is formed in the shaft supporting portion 9*b* as shown in FIG. 2. In other words, when the belt 3 and the transfer shaft 5 are contacted with the drum 1 surface with pressure by the action of the compression springs 8, they can follow the drum even when the drum 1 is inclined. Distance $S_1$ between the upper end of the aforementioned hole and the shaft at the shaft supporting portion 9*b* is not more than several millimeters, and distance $S_2$ between the lower end of the aforementioned hole and the shaft is also not more than several millimeters. That is, the amount of movement of the shaft 3 in the shaft supporting portion 9*b* is very small.

Numeral 11 is a shaft for positioning the compression spring 8. The shaft 11 is mounted on the base frame 7. The compression springs 8 and the shaft 11 are made of conductive material, so that the base frame 6 is electrically connected to image forming apparatus body A. Numeral 12 is a cleaning means for cleaning the surface of the belt 2. The cleaning means 12 is mounted on the upper end of a lever 14 which can be rotated around a shaft 13, and contacted with the surface of the belt 3 with pressure.

Numeral 16 is a guide plate to guide a recording paper to the transfer section, and numeral 17 is a guide plate to guide a recording paper which has been sent out from the transfer section, to a fixing unit 18. Numeral 19 is a hinge shaft to connect upper body $A_1$ and lower body $A_2$ of image forming apparatus body A. Numeral 20 is a lever to restrict the opening amount of upper body $A_1$.

While a color image is formed on the drum surface by a developing unit not shown, using toners of various colors, the transfer conveyance unit 2 is sufficiently separated from the drum surface as shown in FIG. 1-*b*. When a toner image is transferred onto a recording paper after image formation on the drum surface has been completed, the transfer conveyance unit 2 is actuated by the compression springs 8 and behaves in the manner shown in FIG. 1-*a*, so that the transfer conveyance unit 2 comes into contact with the drum. The operation of adhesion and separation is conducted by a cam or other drive means not shown in the drawing.

In the case where the transfer conveyance unit 2 is contacted with the photoreceptor drum surface with pressure by the action of the compression springs 8 as shown in FIG. 1-*a*, even when the photoreceptor drum or upper body $A_1$ on which the drum is mounted, is inclined, or even when the transfer conveyance unit 2 is inclined, the transfer conveyance unit 2 can sufficiently follow the photoreceptor drum because only one of the shaft supporting portions of the drive shaft 4*a* is vertically fixed, and other portions, that is, the other shaft supporting portion of the drive shaft 4*a* and both shaft supporting portions of the idle shaft 4*b* have a degree of freedom so that they can be moved vertically. Therefore, the transfer conveyance unit 2 can be uniformly contacted with the surface of the photoreceptor drum.

As shown in the example, the present invention is to provide a transfer conveyance unit having a transfer belt by which toner is transferred from a photoreceptor drum onto a paper and the paper is conveyed, and the transfer conveyance unit is characterized in that: the right and left portions of an idle shaft of the transfer conveyance unit are rotated and lifted around a drive shaft by two compression springs, wherein the transfer belt is provided between the idle and drive shafts; and at least one of the drive shaft supporting portions can be rotated around the other drive shaft supporting portion. Therefore, the belt and transfer shaft can be positively contacted with the drum surface with simple structure, and the contacting forces of the right and left can be balanced.

Further, as shown in the example, the present invention is to provide a transfer conveyance unit having a transfer belt by which toner is transferred from a photoreceptor drum onto a paper and the paper is conveyed, and the transfer conveyance unit is characterized in that: a transfer frame provided with a drive shaft, idle shaft and transfer shaft inscribed inside the transfer belt, is mounted on a base frame in such a manner that the transfer frame can be vertically rotated around the drive shaft; and compression springs are provided between the transfer frame and the base frame, wherein the transfer frame is electrically connected to the image forming apparatus body through the compression springs and a compression spring positioning shaft mounted on the base frame. Therefore, a conventional wire to electrically connect the transfer conveyance unit to the ground is not necessary. Accordingly, the movement of the frame on which the belt and the transfer shaft are mounted, is not affected by the wire, so that the belt and the drum can be uniformly contacted with the drum surface.

Next, with reference to FIG. 4 through FIG. 6, the second example of the invention will be explained as follows. FIG. 4-*a* shows a state in which the transfer conveyance unit of the present invention is contacted with the drum with pressure. FIG. 4-*b* shows a state in which the transfer conveyance unit of the present invention is separated from the drum. FIG. 5 is a perspective view of the transfer conveyance unit of the present invention. FIG. 6 is a schematic illustration showing an image forming apparatus body which has been opened in order to show the position of the transfer conveyance unit of the second example.

In the attached drawings, numeral 1 is a photoreceptor drum. As shown in FIG. 6, the photoreceptor drum 1 is provided in upper body $A_1$ of image forming apparatus A, wherein upper body $A_1$ can be opened in such a manner that the upper body $A_1$ is separated from the lower body with regard to a paper passage. Numeral 2 is a transfer conveyance unit of the present invention. The transfer conveyance unit 2 is provided mounted on lower body $A_2$ of the image forming apparatus. As shown in FIGS. 4-*a* and 4-*b*, the photoreceptor drum 1 is rotated in the direction of an arrow.

The transfer conveyance unit 2 is provided with a recording paper conveyance belt 3 which comes into contact with the lower surface of the photoreceptor drum 1. The belt 3 is provided around a drive shaft 4*a* and an idle shaft 4*b*. Numeral 5 is a rotatable transfer shaft upon which a voltage is impressed so that it is electrically charged. The transfer shaft 5 comes into contact with the circumferential surface of the drum 1 through the belt 3 so that a transfer section is constituted in order to transfer a toner image onto a recording paper. This transfer shaft 5 transfers a toner image formed on the photoreceptor drum 1 onto recording paper K which is conveyed by the belt 3.

Numeral 6 is a frame on which the drive shaft 4*a*, the idle shaft 4*b* and the transfer shaft 5 are mounted. The frame 6 is mounted on a base frame 7 so that the frame 6 can be vertically rotated around the drive shaft 4*a*. The base frame 7 is fixed to image forming apparatus body A. Numerals 8 and 8*a* are compression springs provided between the frame 6 and the base frame 7. The compression springs 8 and 8*a* lift up right and left edge portions of the idle shaft 4*b* toward the drum 1. That is, while a transfer operation is performed, the belt 3 and the transfer shaft 5 of the transfer conveyance unit are contacted with the circumferential surface of the drum 1 with pressure.

As shown in FIGS. 4-*a*, 4-*b* and 5, auxiliary compression springs 8*b*, 8*c* located between the compression springs 8, 8*a* and the drive shaft 4*a*, are disposed between the base frame 7 and a fixing plate 6A formed integrally with the frame 6.

The drive shaft 4*a* can be rotated around at least one of the shaft supporting portions 9*a*, 9*b* of the frame 7, for example the drive shaft 4*a* can be rotated around the shaft supporting portion 9*a* provided with a gear 10 which is a drive means of the drive roller. For that reason, a hole, the longitudinal dimension of which is longer than the lateral dimension, is formed in the shaft supporting portion 9*b* as shown in FIG. 5. In other words, when the belt 3 and the transfer shaft 5 are contacted with the drum 1 surface with pressure by the action of the compression springs 8, 8*a* and the auxiliary compression springs 8*b*, 8*c*, they can follow the drum even when the drum 1 is inclined. Distance $S_1$ between the upper end of the hole and the shaft at the shaft supporting portion 9*b* is not more than several millimeters, and distance $S_2$ between the lower end of the hole and the shaft is also not more than several millimeters. That is, the amount of movement of the shaft 3 in the shaft supporting portion 9*b* is very small.

Numeral 11 is a shaft for positioning the compression springs 8, 8*a*. The shaft 11 is mounted on the base frame 7. The compression springs 8, 8*a* and the shaft 11 are made of conductive material, so that the base frame 6 is electrically connected to image forming apparatus body A. Numeral 12 is a cleaning means for cleaning the surface of the belt 2. The cleaning means 12 is mounted on the upper end of a lever 14 which can be rotated around a shaft 13, and contacted with the surface of the belt 3 with pressure.

Numeral 16 is a guide plate to guide a recording paper to the transfer section, and numeral 17 is a guide plate to guide a recording paper which has been sent out from the transfer section, to a fixing unit 18. Numeral 19 is a hinge shaft to connect upper body $A_1$ and lower body $A_2$ of image forming apparatus body A. Numeral 20 is a lever to restrict the opening amount of upper body $A_1$.

While a color image is formed on the drum surface by a developing unit not shown, using toners of various colors, the transfer conveyance unit 2 is sufficiently separated from the drum surface as shown in FIG. 4-*b*. When a toner image is transferred onto a recording paper after image formation on the drum surface has been completed, the transfer conveyance unit 2 is actuated by the compression springs 8, 8*a* and the auxiliary compression springs 8*b*, 8*c*, and behaves in the manner shown in FIG. 4-*a* , so that the transfer conveyance unit 2 comes into contact with the drum. The operation of adhesion and separation is conducted by a cam or other drive means not shown in the drawing.

In the case where the transfer conveyance unit 2 is contacted with the photoreceptor drum surface with pressure by the action of the compression springs 8, 8*a*, and the auxiliary compression springs 8*b*, 8*c* as shown in FIG. 4-*a* , even when the photoreceptor drum or upper body $A_1$ on which the drum is mounted, is inclined, or even when the transfer conveyance unit 2 is inclined , the transfer conveyance unit 2 can sufficiently follow the photoreceptor drum because only one of the shaft supporting portions of the drive shaft 4*a* is vertically fixed, and other portions, that is, the other shaft supporting portion of the drive shaft 4*a* and both shaft supporting portions of the idle shaft 4*b* have a degree of freedom so that they can be moved vertically. Therefore, the transfer conveyance unit 2 can be uniformly contacted with the surface of the photoreceptor drum.

As shown in the example, the present invention is to provide a transfer conveyance unit having a transfer belt by which toner is transferred from a photoreceptor drum onto a paper and the paper is conveyed, and the transfer conveyance unit is characterized in that: the right and left portions of an idle shaft of the transfer conveyance unit are rotated and lifted around a drive shaft by two compression springs, wherein the transfer belt is provided between the idle and drive shafts; and at least one of the drive shaft supporting portions can be rotated around the other drive shaft supporting portion. Therefore, the belt and transfer shaft can be positively contacted with the drum surface with simple structure, and the contacting forces of the right and left can be balanced.

Further, as shown in the example, the present invention is to provide a transfer conveyance unit having a transfer belt by which toner is transferred from a photoreceptor drum onto a paper and the paper is conveyed, and the transfer conveyance unit is characterized in that: a transfer frame provided with a drive shaft, idle shaft and transfer shaft inscribed inside the transfer belt, is mounted on a base frame in such a manner that the transfer frame can be vertically rotated around the drive shaft; and compression springs 8, 8*a* are provided between the transfer frame and the base frame, wherein the transfer frame is electrically connected to the image forming apparatus body through the compression springs 8, 8*a* and a compression spring positioning shaft mounted on the base frame. Therefore, a conventional wire to electrically connect the transfer conveyance unit to the ground is not necessary. Accordingly, the movement of the frame on which the belt and the transfer shaft are mounted, is not affected by the wire. Instead of the compression springs 8, 8*a*, the auxiliary compression springs 8*b*, 8*c* may be utilized for electrically connecting the transfer conveyance unit to the ground. In the manner described above, when the belt and the transfer shaft are contacted with the photoreceptor drum, the contact force of the right and that of the left are made uniform, and there is no possibility that difference is caused between the contact force of the right and that of the left.

What is claimed is:

1. A transfer unit for use in an image forming apparatus for transferring a toner image from a photosensitive drum onto a recording sheet comprising:

conveyance means having a driving roller, a follower roller and a conveyor belt looped around the driving roller and the follower roller for conveying the recording sheet through a transfer location;

transfer means located within the loop of the conveyor belt along a width of the photosensitive drum at the transfer location for transferring the toner image from the photosensitive drum onto the recording sheet;

a rotatable frame fixing thereon three pairs of bearings for supporting the driving roller, the follower roller and the transfer means by the three pairs of bearings, wherein the rotatable frame is adapted to be rotated in both a vertical direction and a rolling direction around a rotation center;

base means located below the rotatable frame and having an upright member for supporting the rotation center at a fixed position by the upright member; and pushing means provided on the base means for rotating the rotatable frame around the rotation center toward the photosensitive drum by pushing the rotatable frame upward at least at three points in a bottom surface of the rotatable frame, whereby the transfer means takes an attitude fitted to a surface of the photosensitive drum along the width thereof at the transfer location.

2. The transfer nit of claim 1, wherein the upright member of the base means comprises:

bearing means for supporting a shaft potion of the driving roller at a fixed position, so that the fixed position functions as the rotation center of the rotatable frame.

3. The transfer unit of claim 2, wherein the pushing means further comprises:

auxiliary pushing means for pushing the rotatable frame at a position near the gravity center of the rotatable frame.

4. The transfer unit of claim 3, wherein the auxiliary pushing means comprises:

a pair of auxiliary springs provided between the rotatable frame and the base frame at two width end portions of the rotatable frame, so that the rotatable frame is pushed upward at a point near the gravity center with a combined pushing force from the pair of the auxiliary springs.

5. The transfer unit of claim 1, wherein the pushing means comprises:

a pair of springs provided on the base means in an upright position for pushing the rotatable frame at two points in the bottom surface thereof nearly under the pair of the bearings which support the follower roller; and a spring provided on the base means in an upright position for pushing the rotatable frame upward at a point near one of the pair of the bearings which support the follower roller.

* * * * *